US007559116B2

(12) United States Patent
Hulbert et al.

(10) Patent No.: US 7,559,116 B2
(45) Date of Patent: Jul. 14, 2009

(54) ARM FOR A PANTOGRAPHIC HINGE DEVICE

(75) Inventors: Jurgen Hulbert, Eltville (DE); Klaus Labbe, Undenheim (DE); Jens Schenkenberger, Frankfurt (DE)

(73) Assignee: GM Global Technology Operations, Inc., Detroit, MI (US)

( * ) Notice: Subject to any disclaimer, the term of this patent is extended or adjusted under 35 U.S.C. 154(b) by 252 days.

(21) Appl. No.: 10/590,047

(22) PCT Filed: Feb. 18, 2005

(86) PCT No.: PCT/EP2005/001734

§ 371 (c)(1),
(2), (4) Date: Aug. 17, 2006

(87) PCT Pub. No.: WO2005/080724

PCT Pub. Date: Sep. 1, 2005

(65) Prior Publication Data

US 2007/0180653 A1 Aug. 9, 2007

(30) Foreign Application Priority Data

Feb. 19, 2004 (DE) ..... 10 2004 008 070

(51) Int. Cl.
*E05D 3/06* (2006.01)

(52) U.S. Cl. ..... 16/366; 16/50

(58) Field of Classification Search ..... 16/366, 16/282, 287, 302, 50, 368; 49/246; 296/146.11, 296/146.12; 244/129.5, 129.4
See application file for complete search history.

(56) References Cited

U.S. PATENT DOCUMENTS

| | | | | |
|---|---|---|---|---|
| 3,016,261 | A * | 1/1962 | Tatter | 49/246 |
| 3,782,036 | A * | 1/1974 | Clark et al. | 49/502 |
| 4,607,812 | A * | 8/1986 | De Haan et al. | 244/129.5 |
| 5,289,615 | A * | 3/1994 | Banks et al. | 16/366 |
| 5,775,028 | A * | 7/1998 | Lambert | 49/248 |
| 6,834,834 | B2 * | 12/2004 | Dazet et al. | 244/129.5 |
| 2007/0084016 | A1 * | 4/2007 | Bommelmann et al. | 16/366 |
| 2007/0096503 | A1 * | 5/2007 | Borleis et al. | 296/146.11 |

FOREIGN PATENT DOCUMENTS

GB 2 080 407 A 2/1982

OTHER PUBLICATIONS

International Search Report for PCT/EP2005/001734, mailed Jun. 1, 2005.

* cited by examiner

*Primary Examiner*—Victor Batson
*Assistant Examiner*—Jeffrey O'Brien
(74) *Attorney, Agent, or Firm*—Ingrassia Fisher & Lorenz, P.C.

(57) ABSTRACT

In a motor vehicle a door and the body are connected by a pantographic hinge device, the arm of which is substantially constructed from a housing module, from which rotatable shaft sections coupled in two end regions project and which has an open side, and a coupling mechanism module for creation of the rotational coupling of the shaft sections to one another, which can be inserted into the housing module through the open side. The coupling mechanism module is inserted into the housing module after the door and body connected to one another through the housing module have been painted.

19 Claims, 2 Drawing Sheets

ARM FOR A PANTOGRAPHIC HINGE DEVICE

CROSS-REFERENCE TO RELATED APPLICATIONS

This application is a U.S. National-Stage Entry under 35 U.S.C. § 371 based on International Application No. PCT/EP2005/001734, filed Feb. 18, 2005, which was published under PCT Article 21(2); this application also claims priority under 35 U.S.C. § 119 to German Application No. 10 2004 008 070.4, filed Feb. 19, 2004.

FIELD OF THE INVENTION

The present invention relates to an arm for a pantographic hinge device, in particular for the attachment of a motor vehicle door to a vehicle body, a motor vehicle fitted with such an arm and also a method for its assembly.

BACKGROUND OF THE INVENTION

Pantographic hinges for doors, which instead of a pivotal movement of the door leaf allows a movement on a circle sector-shaped path while retaining the orientation of the door leaf, have long been known in buses. Recently, pantograph hinges for automobiles have been proposed, in which the mechanism that secures the orientation of the door during the opening and closing movement is housed inside a single arm. This mechanism must not be exposed together with the vehicle body and the door to the usual painting process for these parts, and therefore it has been necessary hitherto to paint the vehicle body and doors separately from one another and then assemble them. The associated work effort represents a disadvantage of pantograph doors over conventional swivel doors, for which such a joint painting operation with the vehicle body forms part of usual manufacturing practice.

BRIEF SUMMARY OF THE INVENTION

A first object of the present invention is to propose an arm of simple and compact structure for a pantographic hinge device, which allows parts connected by the arm, in particular therefore a vehicle body and door, to be painted together, while excluding any risk to the mechanism of the hinge device from the painting process.

A further object of the invention is to propose a motor vehicle, the body and door of which are connected through a pantographic hinge device and which can be painted together during assembly of the vehicle, as well as a method for the assembly of such a motor vehicle.

The invention provides that the arm is constructed from a housing module, from which rotatable shaft sections coupled in two end regions project to fasten to a respective one of the two parts to be connected to one another, and a coupling mechanism module, which can be inserted into the housing module through an open side thereof in order to create the rotational coupling of the shaft sections to one another.

To enable a secure fastening of the arm on the parts to be connected by it, two shaft sections preferably coaxially project on opposite sides of the housing module at each end of the arm.

The connection between the shaft sections and the coupling mechanism module required for the rotational coupling is preferably formed by a groove-spring arrangement. Such an arrangement allows creation of a connected fixed against rotation by simply inserting the groove and spring into one another in the longitudinal direction thereof without having to deform the housing module holding the shaft sections or releasing the shaft sections for this.

When the arm is fully assembled, the groove and spring are preferably secured to one another through a pin, which traverses both.

The coupling mechanism can expediently be formed with two pulleys coupled by a pulling strap.

Each of these pulleys can preferably be connected directly to one of the shaft sections.

The coupling mechanism module can be provided with a rear panel, which in the assembled state covers the open side of the housing module. However, a covering of the open side can also be provided by a cap part, which can be snapped onto the open side and surfaces of the housing module adjoining this.

The invention also relates to a motor vehicle, in which a door and a body are connected through an arm, as defined above, as well as to a method for the production of such a motor vehicle, in which firstly the door is fastened to the body of the motor vehicle solely by means of the housing module, the body and the door fastened to it are then painted and finally the coupling mechanism module is inserted into the housing module.

Between the painting and the insertion of the coupling mechanism module, the door can be removed from the vehicle body in order to attach internal fittings in the body. Once this has occurred, the door and body are connected to one another again, wherein the coupling mechanism module can be inserted on the door both when separated from the vehicle body and after re-assembly of the body and the door into the housing module.

BRIEF DESCRIPTION OF THE DRAWINGS

Further features of the invention may be seen from the following description of an embodiment with reference to the attached figures.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
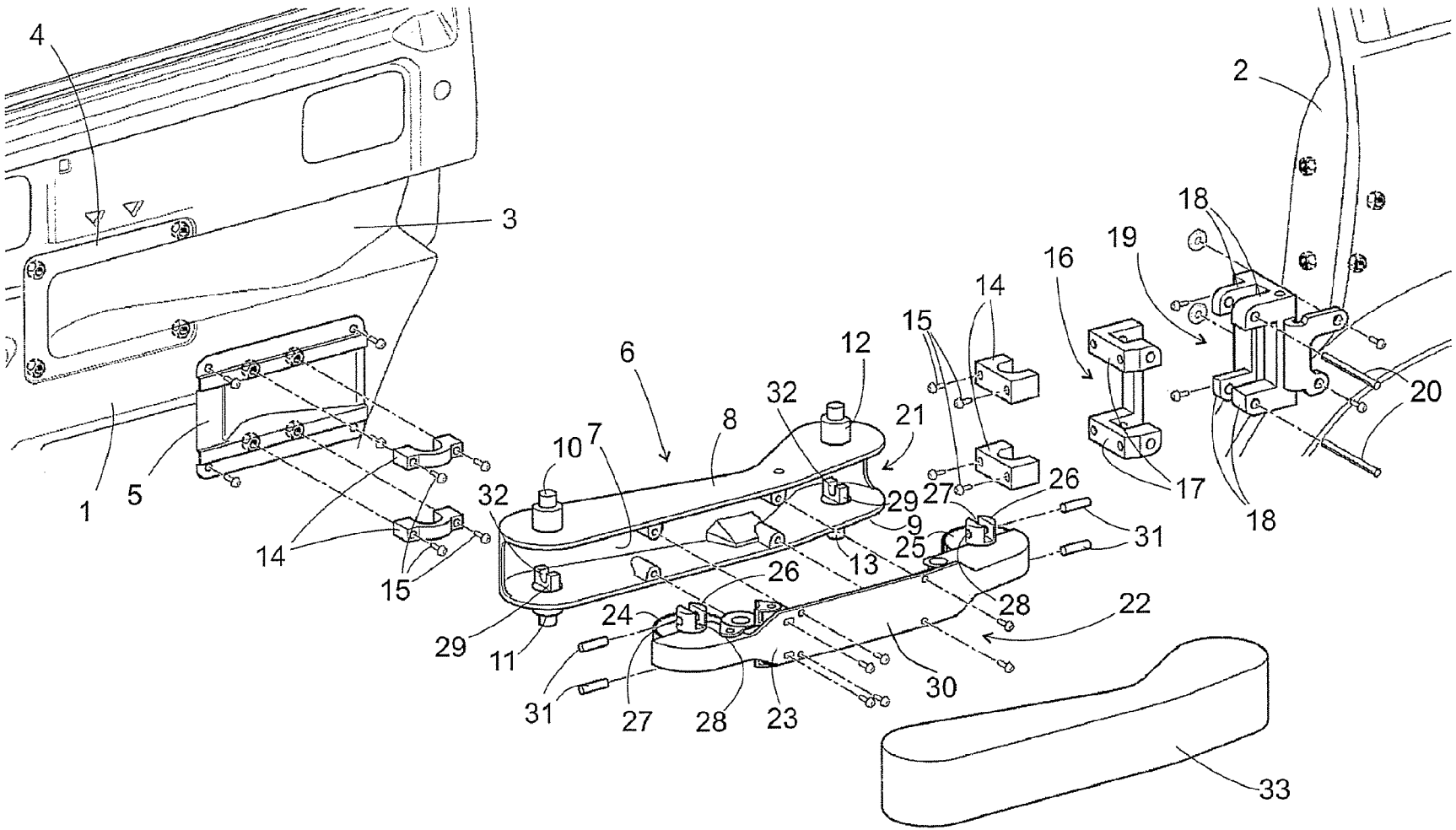
FIG. 1 is an exploded view of an arm for a pantograph hinge according to the invention and its surrounding area in a motor vehicle.
Figure 2:
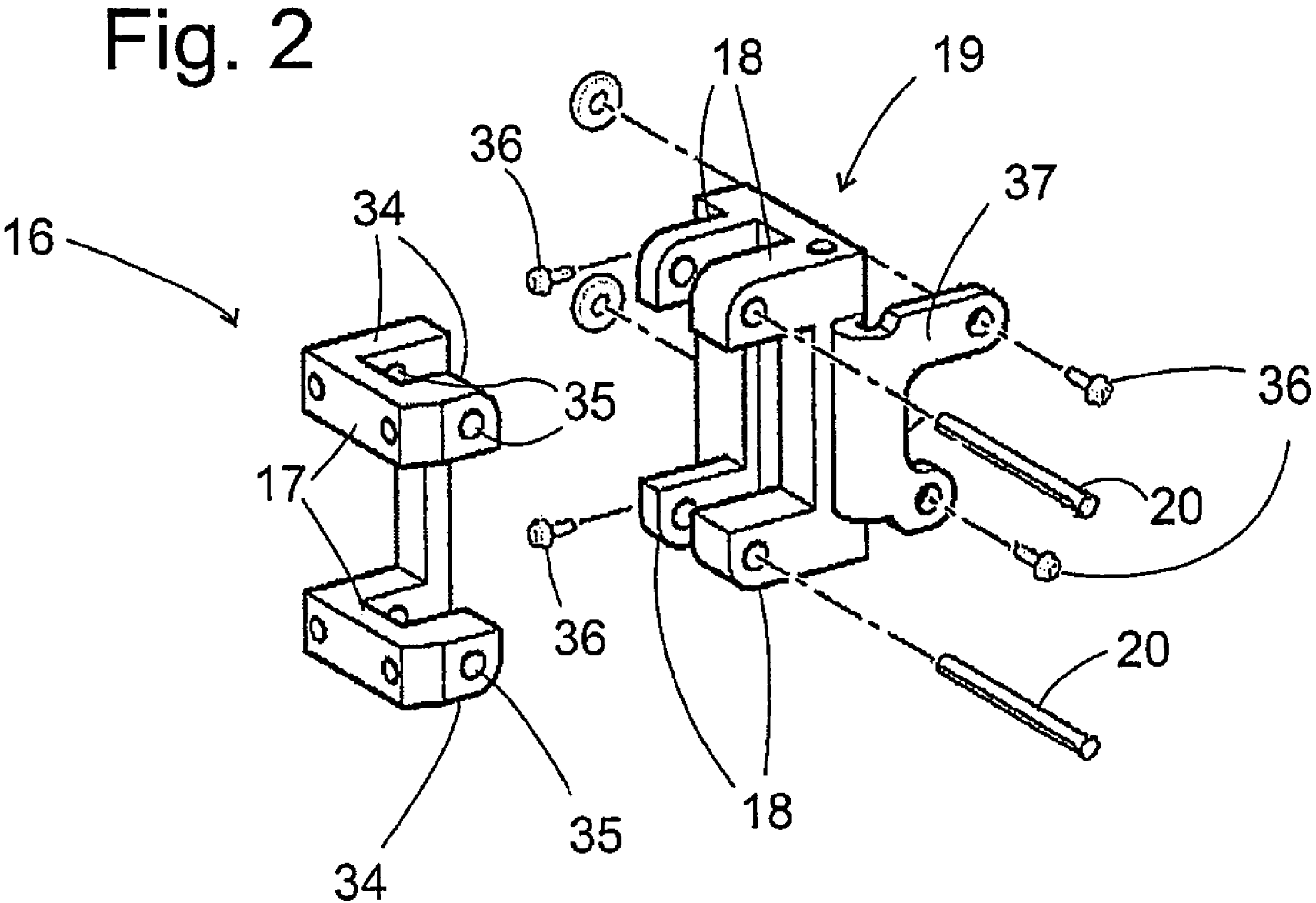
FIG. 2 are the adapter pieces of FIG. 1 in greater detail.

In a perspective view FIG. 1 shows the components of the hinge arm according to the invention as well as connection parts for its fastening both on the inside of a rear door 1 of a motor vehicle and on the C-column of the body 2. In the still unclad door 1 on its inside a horizontal channel 3 is formed, which is open towards the rear edge of the door and is surrounded towards the front by a C-shaped fastening frame 4. This frame 4 is provided for anchorage of a head piece 5 of a pantograph hinge on the door side.

The head piece 5 is a metal sheet reinforced by two parallel ribs and screwed to threads of the fastening frame 4 at its corners through drilled holes. A central depression of the head piece fits snugly into the channel 3. In the closed position of the door 1 a housing module 6 of the articulated arm fits into the central recess of the head piece 5 and the channel 3.

The housing module 6 has a closed outer side 7 facing the base of the channel 3, an upper and lower side 8, 9 and on its inside facing the passenger compartment has an elongated open side 21. Two shaft sections 10, 11, 12, 13 are respectively held in the upper and lower side 8, 9 of the metal housing module 6 to be rotatable around their axis. The ends of the shaft sections 10, 11 projecting from the housing module 6 are provided to be mounted on the head piece 5 on the door side to be fixed against rotation by means of clamps 14 and screws 15. The shaft sections 12, 13 are provided accordingly on the opposite end region of the housing module 6 to be mounted on a first adapter piece 16 to be fixed against rotation by means of clamps 14 and screws 15.

The first adapter piece comprises two U-shaped interconnected yokes 17, to the base of which the clamps 14 are respectively screwed and the legs of which are drilled on a common line. These two legs are provided to engage between or next to likewise drilled journals 18 of a second adapter piece 19, where they are arrested by means of pins 20 inserted through the then aligned drill holes of the legs 17 and the journals 18. The second adapter piece 19 is in turn provided to be screwed to four locations of the C-column.

During assembly of the motor vehicle the mentioned parts are fastened to one another in an appropriate sequence in the manner outlined in order to thus create a connection between the vehicle body 2 and the door 1, which allows the body and door to be conveyed through a painting plant and painted therein. During painting it is expedient to additionally immobilise the door 1 and body 2 relative to one another, since the shaft sections 10 to 13 are all actually rotatable relative to the housing module 6, and therefore neither the possibility of the housing module rotating relative to the vehicle body 2 nor of the door 1 rotating relative to the housing module 6 is excluded.

After painting, the pins 20 between the two adapter pieces 16, 19 are removed, so that the door including the housing module 6 held thereon can be removed from the body. The door opening of the body is now free to allow work on the internal fittings of the vehicle to occur unhindered.

At the same time as the attachment of the internal fittings, a coupling mechanism module 22 can be inserted into the open side 21 on the detached door. The coupling mechanism module 22 is constructed from an elongated metal support 23, on the longitudinal ends of which a pulley 24, 25 is respectively rotatably held. The two pulleys are rotatably coupled firmly to one another by an endless belt (not shown in the figure) looped around them and rotate at the same speed. At both ends of the shafts of the pulleys 24, 25 slotted journals 26 are formed, the lower of which in each case is not shown in the figure. A drill hole 27 traverses the two legs of each journal 26 transversely to the slot 28 thereof. The slots 28 are always parallel as a result of the rotational coupling of the pulleys 24, 25. In FIG. 1 they are oriented parallel to a direction of insertion of the coupling mechanism module 22 into the housing module 6, so that tongues 29, which are formed on the shaft sections 10 to 13 and project into the interior of the housing module 6 shift into the slots 28 on placement of the coupling mechanism module 22. Thus, a rotational coupling is formed between the shaft sections 10, 11 on the door side, on one side, and the shaft sections 12, 13 on the body side, on the other.

The support 23 has a widened rear panel 30, which fills the height of the open side 21. Drill holes of the rear panel 30 come to lie in front of ribs, which are provided with a threaded hole and project from the upper and lower side 8, 9 into the interior of the housing module 6, and allow the housing module 6 and the coupling mechanism module 22 to be screwed together.

As may be easily imagined from the figure, the rear panel 30 does not fill the open side 21 over its entire length in the assembled state. Two windows remain at each end, through which locking pins 31 are passed through the holes 27 of the journals 26 and U-shaped cutouts 32 of the tongues 29 in order to secure the shaft sections 10, 11, 12, 13 to the shafts of the pulleys 24, 25 and bring their axes precisely into line.

As a modification (not shown) it would be possible to omit the holes 27 and the locking pins 31. Then the windows would also be unnecessary for insertion of the locking pins, and the widened rear panel 30 could extend over the entire length of the support 23, so that the support would completely close off the open side 21 in the assembled state. As a last step in the assembly of the arm, a plastic cap part 33 is also attached, which completely conceals the open side 21 with the coupling mechanism module 22 therein as well as the upper and lower side 8, 9 of the housing module 6.

The door with the articulated arm fully assembled and ready for use can now be mounted again on the body by joining the adapter pieces 16, 19 and fastening them by the pins 20 or possibly by screws in place of these.

The door can, of course, also be re-mounted after the internal fittings have been installed in the vehicle in the same state as when it was removed after painting, and the assembly of the coupling mechanism module 22 and cap part 33 occurs on the otherwise completely assembled body.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

The invention claimed is:

1. A pantographic hinge device comprising: a housing module having two end regions and an open side; rotatable shaft sections projecting from the two end regions of said housing module; and a coupling mechanism module separate from the housing module comprising: an elongated support having longitudinal ends; two pulleys rotatably held at the longitudinal ends of the elongated support and configured to mate with the rotatable shaft sections in the housing module; and a pulley belt coupled to the two pulleys;

wherein the coupling mechanism module is configured for insertion into said open side of said housing module to thereby rotationally couple the rotatable shaft sections to one another, and wherein the two pulleys are each configured to be coupled to at least one of the rotatable shaft sections;

wherein the housing module with the rotatable shaft sections includes structural support configured to support a vehicle door separate from the coupling mechanism module during a painting process.

2. The hinge device according to claim 1, wherein the two shaft sections coaxially project on opposite sides of the housing module at each end of the arm.

3. The hinge device according to claim 1, wherein the shaft sections are connected to the coupling mechanism module by a groove and tongue arrangement fixed against rotation.

4. The hinge device according to claim 3, wherein the groove and tongue are secured by a pin traversing both.

5. The hinge device according to claim 1, wherein each pulley is configured for a direct connection to one of the shaft sections.

6. The hinge device according to claim 1, wherein a rear panel of the coupling mechanism module at least partially covers the open side.

7. The hinge device according to claim 1, further comprising a cap part configured to fit over the open side and surfaces of the housing module and cover the open side.

8. The hinge device of claim 1 wherein the pantographic hinge device is configured for coupling a vehicle door to a vehicle frame.

9. The hinge device of claim 8 wherein the rotatable shaft sections comprise a first set and a second set of rotatable shaft sections projecting from the two end regions of said housing module, respectively, wherein the first set of rotatable shaft sections are configured to couple the housing module to the vehicle door and the second set of rotatable shaft sections are configured to couple the housing module to the vehicle frame.

10. A motor vehicle, comprising: a door of the motor vehicle, a body of the motor vehicle; and a pantographic hinge device connecting the door and the body, the hinge device having an arm comprising: a housing module having two end regions and an open side; rotatable shaft sections projecting from the two end regions of said housing module to thereby couple the housing module to the door and the body of the motor vehicle; and a coupling mechanism module separate from the housing module comprising: an elongated support having longitudinal ends; two pulleys rotatably held at the longitudinal ends of the elongated support; and a pulley belt coupled to the two pulleys; wherein the coupling mechanism module is configured for insertion into said open side of said housing module to thereby rotationally couple the rotatable shaft sections to one another, wherein two pulleys are each configured to be coupled to at least one of the rotatable shaft sections, and wherein the rotatable shaft sections comprise a first set and a second set of rotatable shaft sections projecting from the two end regions of said housing module, respectively, wherein the housing module with the rotatable shaft sections includes structural support configured to support the door separate from the coupling mechanism module during a painting process.

11. A motor vehicle according to claim 10 wherein the two pulleys each have a slotted journal which are maintained parallel to one another by the coupling mechanism module.

12. A motor vehicle according to claim 10, wherein the housing module has an upper side support and a lower side support, connected together through an outer side support, together forming an interior of the housing module and also forming the open side opposite the outer side support.

13. A motor vehicle according to claim 12 wherein the first set and the second set of rotatable shaft sections each extend through the upper side support into the interior of the housing module, and through the lower side support into the interior of the housing module, and wherein the rotatable shaft sections each comprise a tongue that projects into the interior of the housing module.

14. A motor vehicle according to claim 12, wherein the first set and the second set of rotatable shaft sections each comprise an upper portion and a lower portion, with the upper portion of the first and second rotatable shaft sections rotatably mounted in the upper side support of the housing module, and the lower portion of the first and second rotatable shaft sections rotatably mounted in the lower side support of the housing module.

15. A motor vehicle according to claim 14 wherein the upper and lower portion of the first set of rotatable shaft sections are coupled together through one of the pulleys in the coupling mechanism and wherein the upper and lower portion of the second set of rotatable shaft sections are coupled together through the other one of the pulleys in the coupling mechanism.

16. A motor vehicle according to claim 12 wherein the coupling mechanism module further comprises a rear panel support having two longitudinal ends, the rear panel support covering at least a portion of the open side, and wherein the two pulleys are rotatably coupled to the two longitudinal ends of the rear panel support.

17. A motor vehicle according to claim 16 wherein the upper side support and lower side support of the housing module are substantially parallel and have supports for screws to mount the coupling mechanism module, and wherein the rear support panel has openings for the screws to mount the coupling mechanism module to the housing module.

18. A method for producing a motor vehicle, in which an arm connects a door to a body of the motor vehicle wherein the arm comprises a housing module having two end regions and an open side, rotatable shaft sections projecting from the two end regions of the housing module, and a coupling mechanism module separate from the housing module comprising: an elongated support having longitudinal ends; two pulleys rotatably held at the longitudinal ends of the elongated support; and a pulley belt coupled to the two pulleys; wherein the coupling mechanism module is configured for insertion into the open side of said housing module, and wherein the housing module with the rotatable shaft sections includes structural support configured to support the door separate from the coupling mechanism module during a painting process the method comprising the steps of: fastening the door to the body of the motor vehicle with the housing module of the arm; painting the body and the door fastened thereto; and after the painting step, subsequently inserting the coupling mechanism module into the housing module to thereby rotationally couple the rotatable shaft sections to one another.

19. The method according to claim 18, wherein between the painting and inserting steps the door is separated from the body and internal fittings are attached in the body, and wherein after attachment of the internal fittings the door and body are connected again.

* * * * *